US005692671A

United States Patent [19]

Mussier et al.

[11] Patent Number: 5,692,671

[45] Date of Patent: Dec. 2, 1997

[54] CARDBOARD PACKAGING DESIGNED TO BE HOOKED ONTO A DISPLAY

[75] Inventors: Alain G. Mussier, Chalon sur Saone Cedex; Bernard Gillier, Chalon sur Saone, both of France

[73] Assignee: Eastman Kodak Company, Rochester, N.Y.

[21] Appl. No.: 780,280

[22] Filed: Jan. 9, 1997

[30] Foreign Application Priority Data

Jan. 11, 1996 [FR] France ..... 96 00445

[51] Int. Cl.[6] ..... B65D 5/468

[52] U.S. Cl. ..... 229/117.14; 206/806

[58] Field of Search ..... 229/117.13, 117.14, 229/163; 206/461, 462, 806

[56] References Cited

U.S. PATENT DOCUMENTS

| | | | |
|---|---|---|---|
| 1,408,752 | 3/1922 | List | 206/806 |
| 3,002,651 | 10/1961 | Gauld | 206/806 |
| 3,507,442 | 4/1970 | Van Dam et al. | 229/117.14 |
| 3,556,292 | 1/1971 | Krzyzanowski . | |
| 3,814,303 | 6/1974 | Smith . | |
| 3,946,936 | 3/1976 | Brown | 206/806 |
| 4,106,615 | 8/1978 | Hiroshi . | |
| 4,308,986 | 1/1982 | Parrilli | 206/806 |
| 4,355,758 | 10/1982 | Lavery | 206/806 |
| 4,917,290 | 4/1990 | Saiki et al. | 229/117.14 |
| 4,949,845 | 8/1990 | Dixon | 206/806 |
| 5,474,183 | 12/1995 | Warren et al. | 206/806 |
| 5,605,278 | 2/1997 | Jensen | 206/806 |

FOREIGN PATENT DOCUMENTS

| | | | |
|---|---|---|---|
| 0 501 588 A1 | 9/1992 | European Pat. Off. . | |
| 91 15 188.0 | 12/1991 | Germany . | |
| 92 07 369.7 | 8/1992 | Germany . | |
| 92 11 017.7 | 10/1992 | Germany . | |
| 4322555 | 1/1995 | Germany . | |
| 2017644 | 10/1979 | United Kingdom | 206/806 |

*Primary Examiner*—Gary E. Elkins
*Attorney, Agent, or Firm*—Susan L. Parulski

[57] ABSTRACT

The invention relates to packaging. The invention is able to be used to produce cardboard boxes (50) having, on the one hand, two openings (52a, 52b) each provided with four flaps designed to close off the corresponding openings and, on the other hand, a hooking lug (22) provided with a hooking opening (13) substantially aligned with the two openings. The size of the package being defined by the size of the rear panel. The blank used to obtain the package could be printed on one side only.

2 Claims, 5 Drawing Sheets

CARDBOARD PACKAGING DESIGNED TO BE HOOKED ONTO A DISPLAY

FIELD OF THE INVENTION

The present invention relates to the field of packaging, and particularly to packages designed to be hooked onto displays. More particularly, the display is a cardboard packaging having a hooking lug provided with a hooking opening and a box having two openings aligned with the hooking opening.

BACKGROUND OF THE INVENTION

Cardboard boxes with hooking lugs are well known in the art of packaging. They are generally produced by gluing a box to a sheet of cardboard serving as a hooking lug. Packages have also been proposed which are formed from a single cardboard blank, such as the one depicted in FIGS. 8 and 9, for example, in which the hooking lug is formed by bonding two end panels to each other. This type of packaging, though easy to produce, has the drawback of having its largest dimension disposed horizontally when it is hooked onto a display. When such boxes are disposed on a display, they can easily be shifted when the display is knocked and, owing to their low height in relation to their width, they resume their original position only with difficulty.

Cardboard boxes have also been proposed with hooking lugs; the openings of said boxes being aligned with the respective hooking lug. This embodiment, similar to the box described in U.S. Pat. No. 4,106,615 and depicted in FIGS. 10 and 11, consists of a traditional box, one of whose flaps has been converted to form a hooking lug and whose opposite flap has been enlarged and convened to become a tucked-in lug. This type of packaging requires special equipment for its closure.

Another type of boxes, such as disclosed in DE 4,322,555 has been proposed. Said document describes boxes similar to those depicted in FIG. 1 and 2. However, for boxes of relatively small sizes, a carded box of such a type could be easily hidden. Consequently, there is a need for packages of relatively larger sizes than the box in order to prevent shoplifting. A solution to such a packaging has been contemplated in DE-U-9211017 wherein a conventional box is attached to a larger hooking flap through an intermediate flap in order to locate said box in a central opening of said hooking flap. The problem with the boxes proposed in said document resides in the fact that they are difficult to be industrially manufactured since the box has to be fill n before passing through the aperture of the carded flap.

SUMMARY OF THE INVENTION

One object of the present invention aims to produce a packaging with a hooking lug from a single blank having been printed on a single side and whose opening are provided with four flaps and are aligned with the hooking lug; the container being smaller than the packaging.

Another object of the invention aims to produce a packaging whose openings have a traditional form with four flaps, so as to be able to use conventional equipment. In packaging of this type, the two lateral flaps are used to square the box, one of the other flaps acts as a flat support to receive the glue and the other flap enables the box to be closed and displayed. The packaging needs to be able to be delivered in a practically flat form and it must be easy to use. Furthermore, automation of its filling and closing must be easy to achieve.

For ecological reasons, it is advantageous to be able to produce such a packaging from cardboard.

The objects of the invention are achieved with a blank for a cardboard box with a hooking lug in which: on the one hand the box has a width L1, a height H1 and a depth P, the height H1 of the box being the largest dimension of said box, and on the other hand the hooking lug has a height H2 and a width L2 larger than L1 and is provided with a hooking opening, the largest dimension of the box being practically aligned with the hooking opening of the hooking lug. This blank comprises:

a first panel, having a width L2 and a height H3 at least equal to the sum of the height H1 of the box and the height H2 of the hooking lug, consisting of a first part adapted to receive the box and a second part adjacent to said first part provided with a hooking opening and designed to form the hooking lug, said first panel serving to define the size of the packaging, connected to the first part of the first panel by a side parallel to the height of the box, a first auxiliary panel of height H1 and width equal to a first size less than the difference between the width of the first panel and the width of the box, hinged to said first auxiliary panel by the side opposite said first panel, a second panel of height H1 and width P serving as a lateral panel of the box, this second panel being provided, on the two opposing sides of dimension P, with two flaps designed to at least partially close the opening in the box, hinged on the side of the second panel opposite the first auxiliary panel, a third panel with the width L1 and height H1 of the box, this third panel being provided, on the two opposite sides of dimension L1, with two flaps designed to at least partially close the openings of the box, hinged on the side of the third panel opposite the second panel, a fourth panel of width P and height H1, practically identical to the second panel, this third panel being provided, on the two opposite sides of dimension P, with two flaps designed to at least partially close the openings of the box, hinged on the side of the fourth panel opposite the third panel, a fifth panel, of height H1 and width L1, substantially identical to the third panel, serving as gluing lug to connect the side of the fourth panel opposite the third panel to the first part of the first panel at said first predetermined distance from the edge of said first panel connected to said auxiliary panel so as to form a practically parallelepiped box having, at each opening, flaps designed to totally close the box, hinged on the second part of the first panel defining the hooking lug, a flap with a size equal to said second part and designed to be folded over and glued to said second part so as to form the hooking lug, this flap comprising an opening corresponding to the opening arranged in the second part, hinged on the first part of the first panel, opposite the first auxiliary panel, a second auxiliary panel of height H1 and width equal to a second size so that the sum of said first size and said second size is equal to the difference between the width of the first panel and the width of the box, said auxiliary panel being designed to be folded over and glued to said first part, hinged along the width of the first part of the first panel opposite the second part, a flap having a width equal to that of the first panel and a height equal tot he difference between the height H3 and the sum of the height H1 of the box and the height H2 of the hooking lug.

BRIEF DESCRIPTION OF THE DRAWINGS

Other advantages of the invention will emerge from a reading of the description that follows, given with reference to the accompanying drawing in which.

DESCRIPTION OF THE PREFERRED EMBODIMENT

Figure 4:
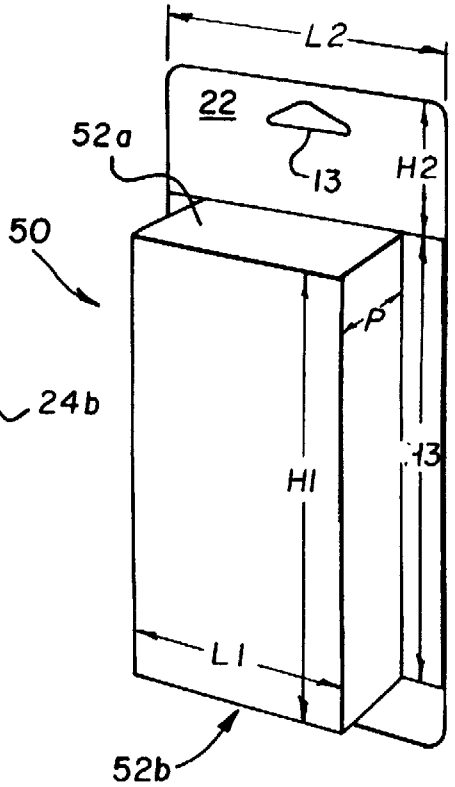
FIG. 4 is a perspective view of a packaging obtained by means of the blank depicted in FIG. 3.

As can be seen in FIG. 4, the invention sets out to provide a box 50 provided with a hooking lug 11 and whose openings 52a, 52b are aligned with the hooking lug 12. According to the invention, the rear panel has dimensions greater than the dimensions of the box.

Figure 3:
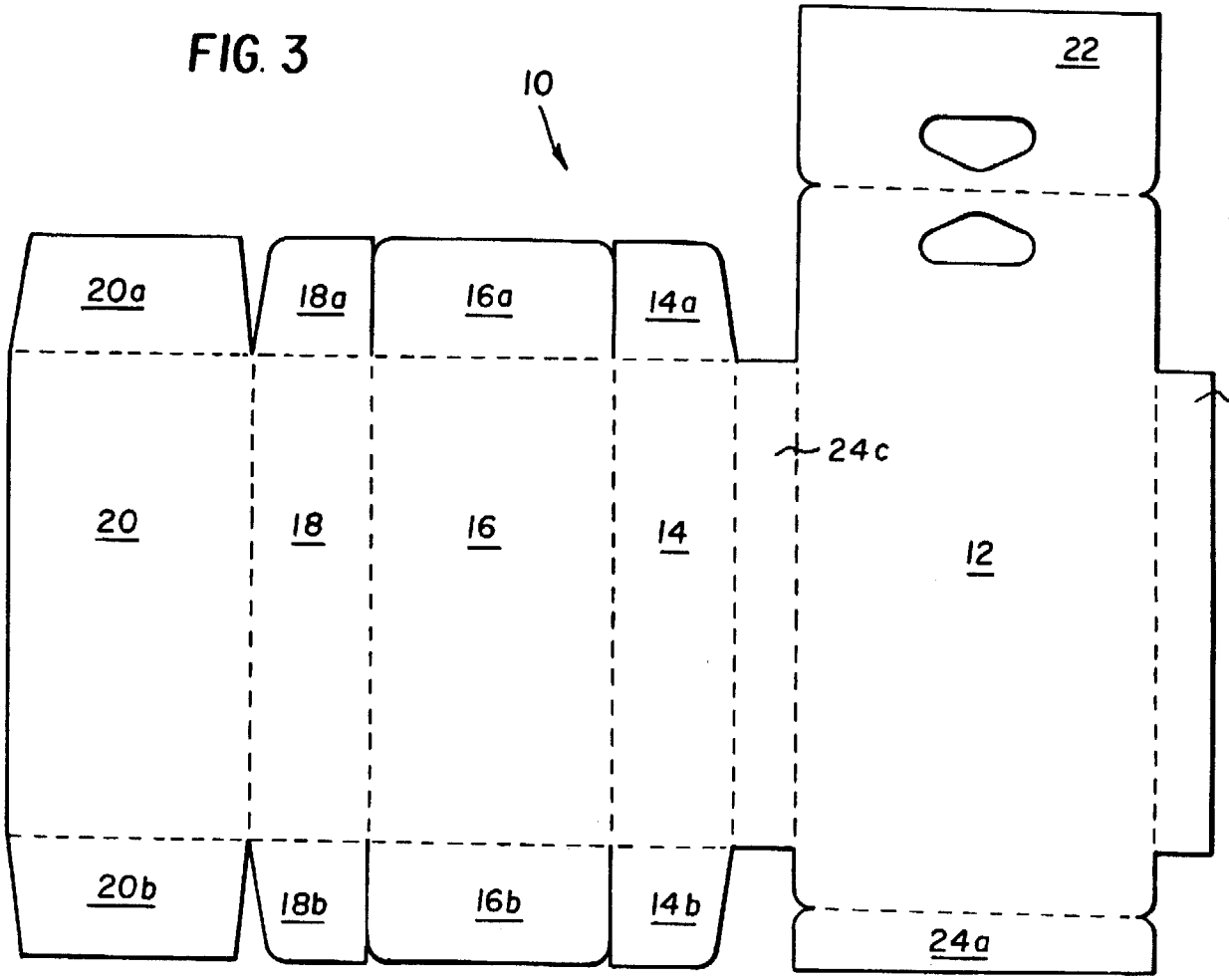
FIG. 3 depicts a second embodiment according to the invention.

As can be seen in FIG. 3, the box is formed from a single cardboard blank 10. The blank has a series of panels hinged on each other. A first panel 12, serving as a rear panel, has a first part 12a whose height H1 is at least equal to the height of the box and whose width L2 is larger than the width L1 of the box an a second part 12b whose height H2 corresponds to the height of the hooking lug 11. The hooking lug is provided with a hooking opening 13 whose shape is usually that of an isosceles triangle and whose apex is directed towards the adjacent side. This opening serves to hook the box onto a display.

A lateral auxiliary panel 24c is hinged on the first part 12a of the rear panel 12 in line with the final position of the box on the first panel 12. Said flap has a height equal to the height H1 of the box and has a width of a first size depending on the final position of the box on the first panel 12. Said first dimension is less than the difference between the width L2 of the first panel and the size L1 of the box.

The blank has a second panel 14 which serves as a lateral panel of the box and which is hinged on the first part of the first panel 12. Said second panel 14 has a length H1 which corresponds to the height of the box. The width P of this second panel 14 is equal to the depth of the box. This panel 14 is provided, on its two facing sides, with two flaps 14a and 14b designed to cover at least partially the respective opposite openings of the box.

Hinged on the side of the second panel 14 opposite the first panel 12 there is a third panel 16 which serves as a front panel for the box. The third panel has a length H1 equal to the height of the box and a width L1 equal to the width of this box. The third panel is provided, on its two facing sides, with two flaps 16a and 16b designed to cover the respective opposite openings of the box. In the embodiment depicted, the flaps 16a and 16b cover practically the whole of the corresponding opening 52a, 52b.

A fourth panel 18 is hinged on the side of the third panel opposite the second panel. This fourth panel is identical to the second panel. This panel 18 is provided, on its two facing sides, with two flaps 18a and 18b designed to at least partially cover the respective opposite openings of the box.

A fifth panel 20 is connected to the side of the fourth panel opposite the third panel 16. This fifth panel has a length equal to the height H1 of the box and a width L1 equal to the width of this box. The fifth panel is provided, on its two facing sides, with two flaps 20a and 20b designed to cover the respective opposite openings of the box. In the embodiment depicted, the flaps 20a and 20b cover practically the whole of the corresponding opening 52a, 52b.

Figure 2:
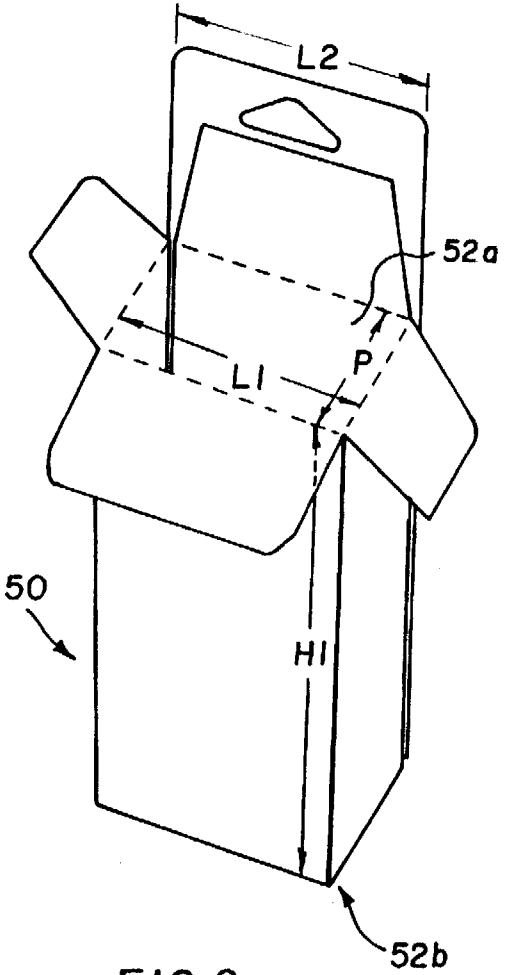
FIG. 2 (PRIOR ART)
FIGS. 1 and 2 depict a blank known in the prior art and the packaging obtained by means of this blank.
Figure 1:
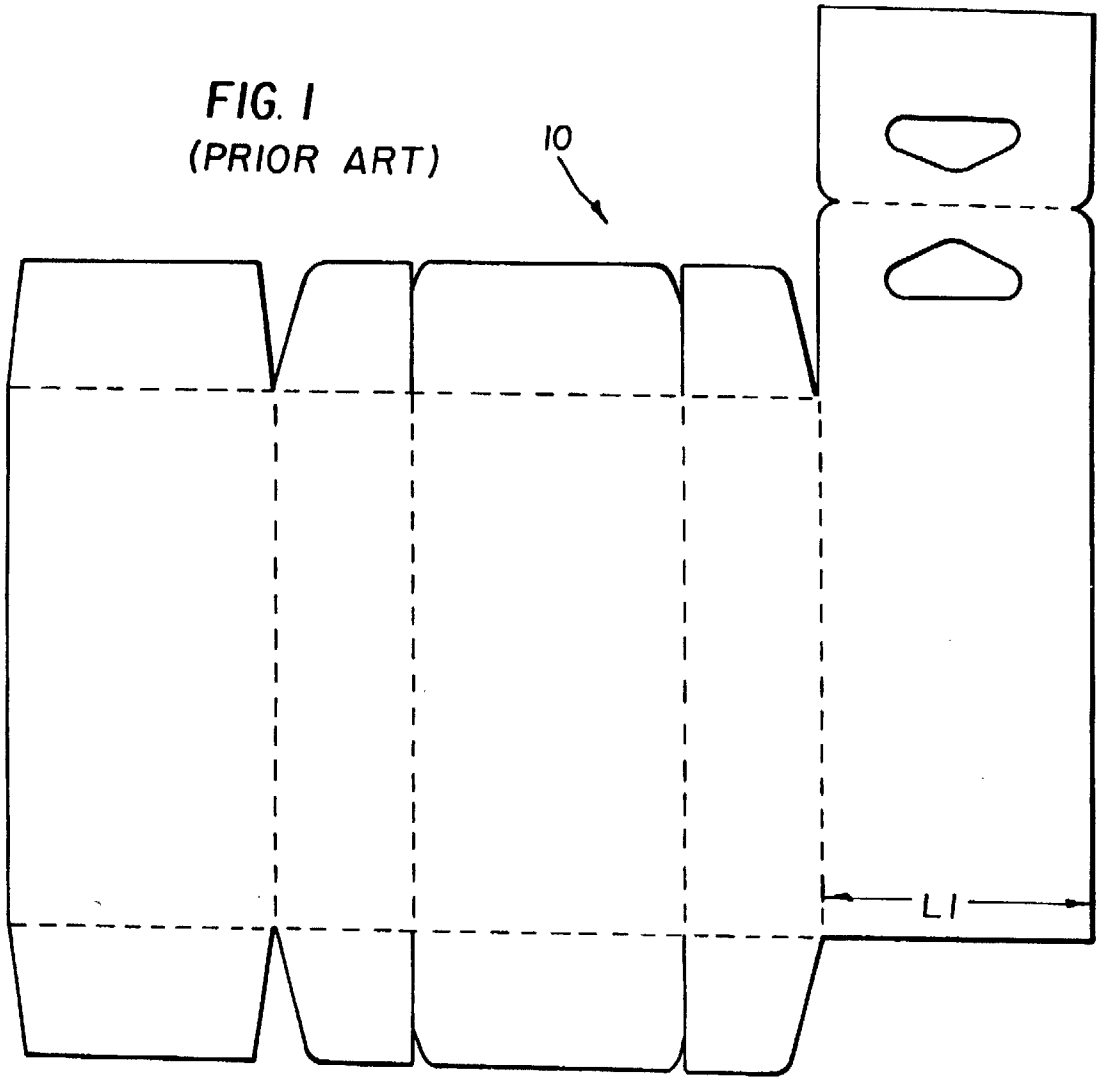
FIG. 1 (PRIOR ART)
Figure 10:
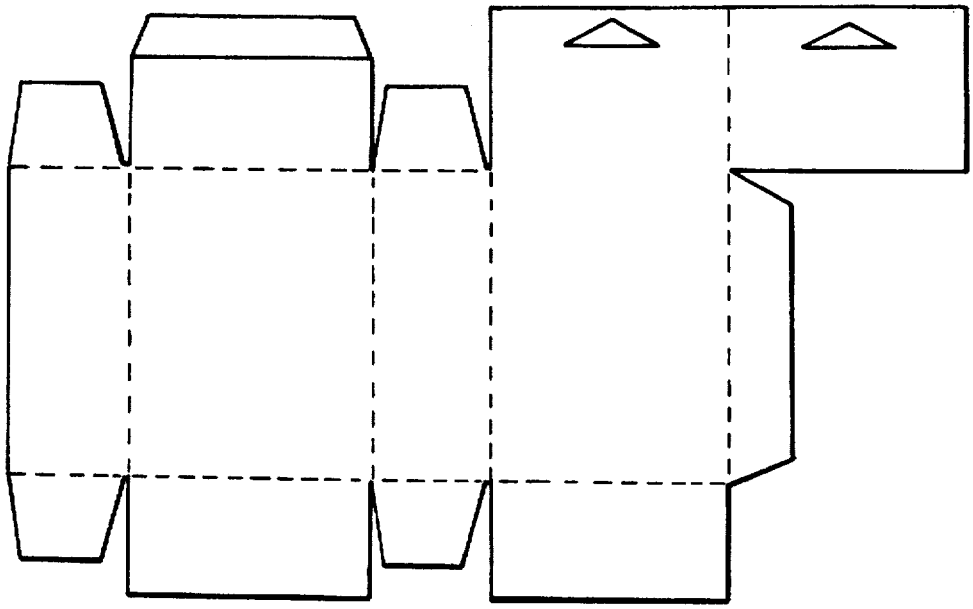
FIG. 10 (prior art)
FIGS. 10 and 11 depict respectively another embodiment of a blank known in the prior art and the packaging obtained by means of this blank.
Figure 11:
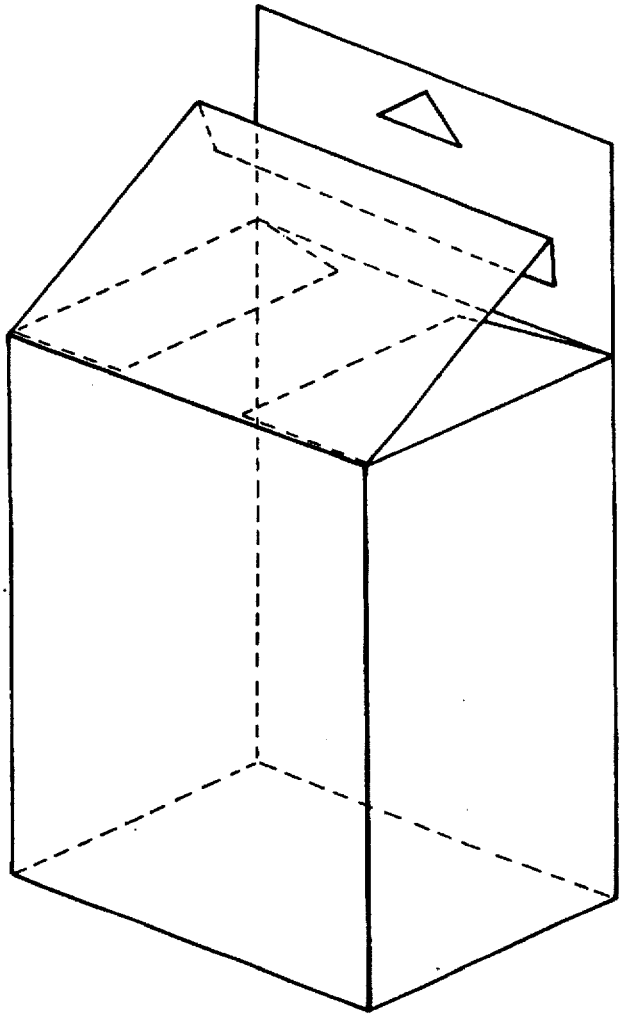
FIG. 11 (prior art)

The rear panel 12 is provided with additional flaps which enable the whole packaging to have the same texture and colouring as the box. A flap 24a is hinged on the first part 12a of the rear panel 12. This flap 24a has a length equal to the width L2 of the first panel and its width is equal to the dimension separating the bottom of the box from the bottom of the first panel. A lateral flap 24b disposed in line with the final position of the box is hinged on the first part of the rear panel 12 opposite the auxiliary panel 24c. This flap 24b has a length equal to the height H1 of the box and a width of a second size equal to the distance separating the box from the lateral edge of the packaging 10. The sum of said second size and said first size is equal to the difference between the width L2 of the rear panel and the width L1 of the box. The blank also has a flap 22 hinged on the second part 12b of the rear panel 12 and of the same size as this hinged on the second part 12b of the rear panel 12 and of the same size as this second part so as to be able to cover it and be glued thereto. The flap 22 and the second part cooperate so as to define the hooking lug 11. The flap 22 has a hooking opening whose shape and position correspond to the hooking opening 13. Advantageously, the flap 22 is hinged along the outer edge of width L2 of the second part 12b of the first panel 12. It is evident that the flap 22 can be connected to the second part of the rear panel 12 by a side other than that depicted in FIGS. 1 or 3, for example as depicted in FIG. 10. It is evident that flap 24a could be provided with a size equal to the width H1 of the box with flaps 24b and 24c having a longer length which extends up to the end of rear panel 12.

Figure 5:
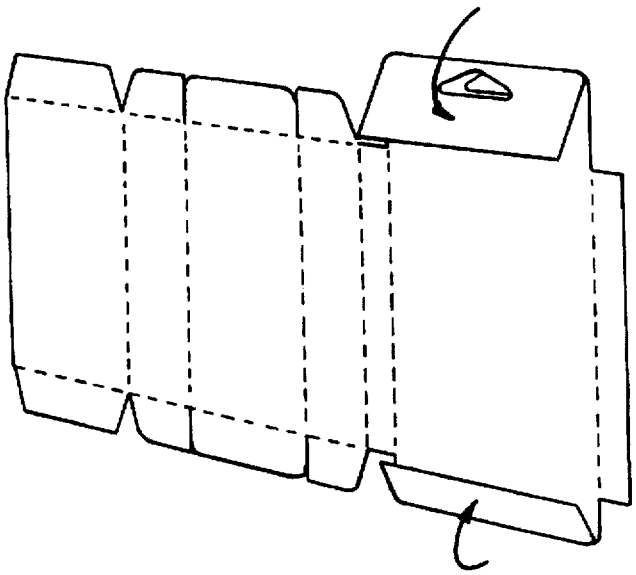
FIGS. 5 to 7 depict diagrammatically the various key steps in transforming the blank depicted in FIG. 3 so as to obtain the packaging depicted in FIG. 4.
Figure 6:
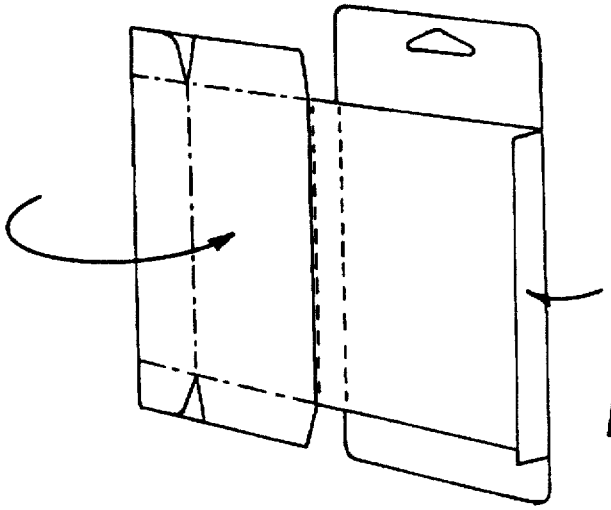
Figure 7:
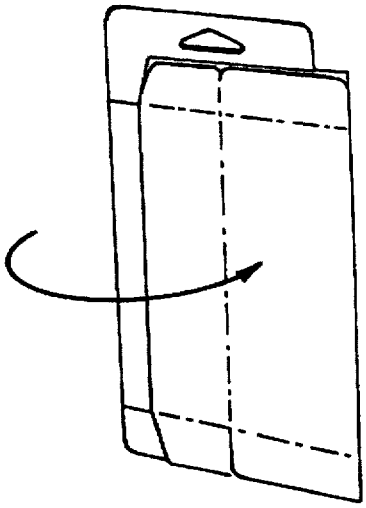
Figure 8:
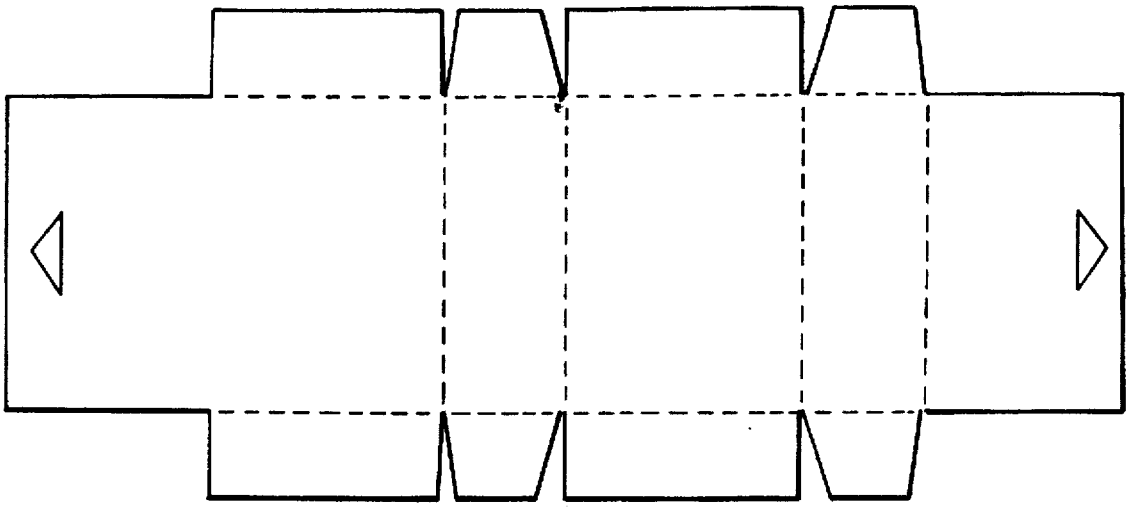
FIG. 8 (prior art)
FIGS. 8 and 9 depict respectively a blank known in the prior art and the packaging obtained by means of this blank.
Figure 9:
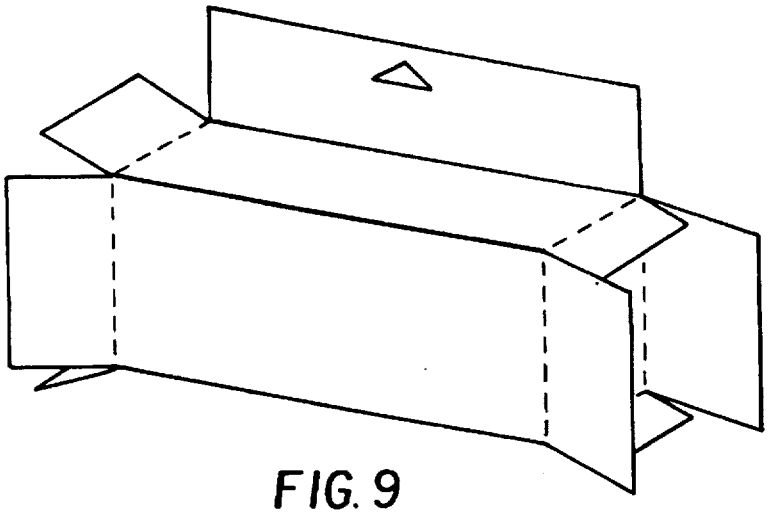
FIG. 9 (prior art)

Reference will now be make to FIGS. 5 to 7, in order to comprehend the production of the box for the purpose of its delivery flat for subsequent use. As can be seen in FIG. 5, the flaps 22 and 24a are glued and then folded over onto the first rear panel 12. In a second operation, depicted in FIG. 6, the blank, folded and glued, is used again to produce the other folds. The area of the rear panel 12 not covered by the flaps 22 and 24a is coated with glue and the flap 24b is folded onto the rear panel 12. At the same time, the panels 18 and 20 are folded along the scoring existing between the panel 18 and the panel 16. Then, as indicated in FIG. 7, all the panels 14, 16, 18, and 20 superimposed by the previous folding are folded along the scoring existing between the rear panel 12 and the panel 24c so as to glue the panels 24c and 20 to the rear panel 12. The packaging is then distributed to the user who can, by means of conventional machines, unfold the packaging to obtain a box, close one of the openings with four flaps, insert the product to be sold into a box and close the other opening with four flaps.

It is evident that the box can be centered with respect to the rear panel as described with reference to FIGS. 1 to 4. However, the widths of the flaps 24a, 24b, and 24c enable the box to be situated at the desired location for the first part 12a of the rear panel 12.

What is claimed is:

1. Blank for a cardboard box with a hooking lug in which: on the one hand the box has a width L1, a height H1 and a depth P, the height H1 of the box being the largest dimension of said box, and on the other hand the hooking lug has a height H2 and a width L2 larger than L1 and is provided with a hooking opening, the largest dimension of the box being practically aligned with the hooking opening of the hooking lug, a blank comprising:

a first panel having a width L2 and a height H3 at least equal to the sum of the height H1 of the box and the height H2 of the hooking lug, consisting of a first part adapted to receive the box and a second part, adjacent to said first part provided with a hooking opening and designed to form the hooking lug, said first panel serving to define the size of the package, connected to the first part of the first panel by a side parallel to the height of the box, a first auxiliary panel of height h1 and width equal to a first size less than the difference between the width of the first panel and the width of the box, hinged to the first auxiliary panel by the side opposite said first panel, a second panel of height H1 and width P serving as a lateral panel of the box, this second panel provided, on the two opposing sides of dimension P, with two flaps designed to at least partially close the openings of the box, hinged on the side of the second panel opposite the first auxiliary panel, a third panel with the width L1 and height H1 of the box, this third panel being provided, on the two opposite sides of dimension L1, with two flaps designed to at least partially close the openings of the box, hinged on the side of the third panel opposite the second panel, a fourth panel of width P and height H1, practically identical to the second panel, this third panel being provided, on the two opposite sides of dimension P, with two flaps designed to at least partially close the openings of the box, hinged on the side of the fourth panel opposite the third panel, a fifth panel, of height H1 and width L1, substantially identical to the third panel, serving as gluing lug to connect the side of the fourth panel opposite the third panel to the first part of the first panel at said first predetermined distance from the edge of said first panel connected to said auxiliary panel so as to form a practically parallelepiped box having, at each opening, flaps designed to totally close the box, hinged on the second part of the first panel defining the hooking lug, a flap with a size equal to said second part and designed to be folded over and glued to said second part so as to form the hooking lug, this flap comprising an opening corresponding to the opening arranged in the second part, hinged on the first part of the first panel, opposite the first auxiliary panel, a second auxiliary panel of height H1 and width equal to a second size so that the sum of said first size and said second size is equal to the difference between the width of the first panel and the width of the box, said auxiliary panel being designed to be folded over and glued to said first part, hinged along the width of the first part of the first panel opposite the second part, a flap having a width equal to that of the first panel and a height equal to the difference between the height H3 and the sum of the height H1 of the box and the height H2 of the hooking lug.

2. Cardboard box with a hooking lug obtained from a bland according to claim 1.

* * * * *